United States Patent [19]

Isfeld

[11] 4,156,942

[45] Jun. 5, 1979

[54] LAMP ASSEMBLY FOR HELMETS, HARD HATS AND THE LIKE

[76] Inventor: Rodney H. Isfeld, Box 69, Gimli, Manitoba, Canada

[21] Appl. No.: 881,688

[22] Filed: Feb. 27, 1978

[51] Int. Cl.[2] ..... A42B 3/00

[52] U.S. Cl. ..... 2/422; 2/209.2; 2/5; 362/106

[58] Field of Search ..... 2/209.2, 5, 422, 185 R, 2/199; 362/105, 106, 107

[56] References Cited

U.S. PATENT DOCUMENTS

| | | | |
|---|---|---|---|
| 1,016,730 | 2/1912 | Bartley | 362/106 |
| 1,485,842 | 3/1924 | Fisher | 362/106 |
| 1,517,180 | 11/1924 | Timlin | 362/106 |
| 2,893,379 | 7/1959 | Springer | 362/105 X |

*Primary Examiner*—Peter Nerbun
*Attorney, Agent, or Firm*—Stanley G. Ade

[57] ABSTRACT

In one embodiment, a battery case and lamp assembly detachably engage with a pair of clips secured to the front of the helmet. In the preferred embodiment a lower horizontal rod attached to the back of the battery case clips into a pair of clips secured to the front of the helmet and a pair of resilient claws at the top of the battery casing, detachably engage any one of a plurality of projecting teeth, also secured to the front of the helmet. The case and lamp assembly pivot around the horizontal rod so that the angle of the lamp assembly can be adjusted to suit the user. Switch means are provided for the lamp assembly to connect and disconnect same from the batteries within the battery case.

8 Claims, 4 Drawing Figures

LAMP ASSEMBLY FOR HELMETS, HARD HATS AND THE LIKE

BACKGROUND OF THE INVENTION

This invention relates to new and useful improvements in lamp assemblies particularly adapted for use with protective hats such as helmets, hard hats and the like.

Users of protective hats such as firemen, rescue workers and the like, often require illumination without interfering with the use of both hands and many attempts have been made to provide head held lamp assemblies for this purpose.

Examples known to the applicant include U.S. Pat. Nos. 1,016,730; 1,914,429; 2,059,977; 2,131,617; 2,234,995; 2,739,311 and 2,893,379.

Some of these are attached to head bands and are adjustable whereas others are attached to safety hats. Some of them are adjustable and others are not and an example of the latter is U.S. Pat. No. 1,914,429 which is specifically designed for use with a fireman's helmet or the like.

The disadvantages inherent in the devices mentioned above are firstly, some are built in as part of the helmet which is expensive and secondly, the method of attachment is inconvenient and not always well suited to the use to which the lamp is being placed.

SUMMARY OF THE INVENTION

The present invention is believed to overcome the disadvantages and provides a lamp assembly for the front of a protective safety hat such as a helmet, hard hat and the like comprising in combination a battery case for detachably receiving dry batteries and a lens assembly secured to said battery case and being operatively connected to the batteries within the battery case, and means to detachably secure said assembly to the front of the associated protective hat.

The preferred embodiment provides a lamp assembly which includes means to adjust, within limits, the angle of the lamp assembly in a fore and aft position relative to the protective hat, said means to adjust said lamp assembly including a longitudinal pivot attachment of the lower side of said battery case to said protective hat, at least one resilient leg extending rearwardly of said battery case adjacent the upper side thereof and means on said front of said protective hat selectively engageable by the distal end of said leg to detachably hold said lamp assembly in the desired angle relative to said protective hat.

Another advantage of the present device is that it is simple in construction, economical in manufacture and otherwise well suited to the purpose for which it is designed.

With the foregoing in view, and other advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figure 1:
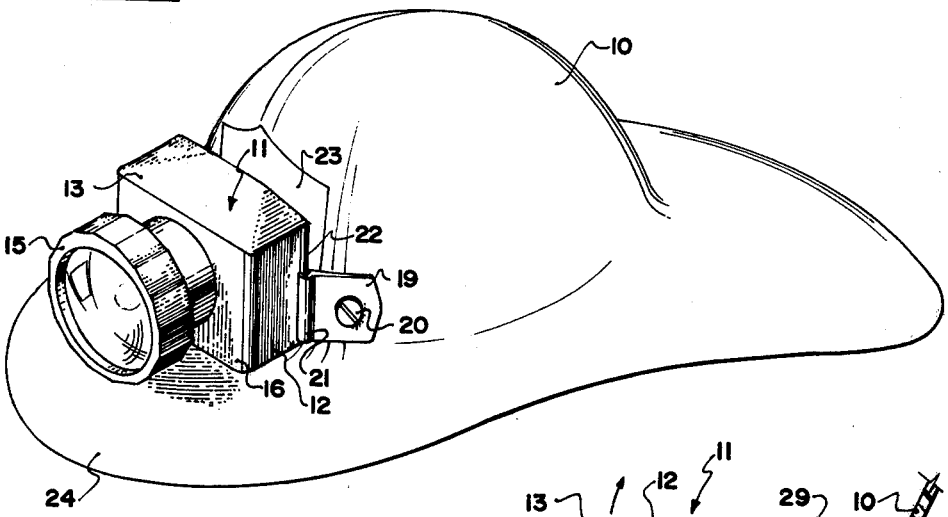
FIG. 1 is an isometric view of a helmet showing one embodiment of the device secured thereto.

Proceeding therefore to describe the invention in detail, reference character 10 illustrates a safety helmet with one embodiment of the invention collectively designated 11, being detachably secured to the front of the helmet.

Figure 3:
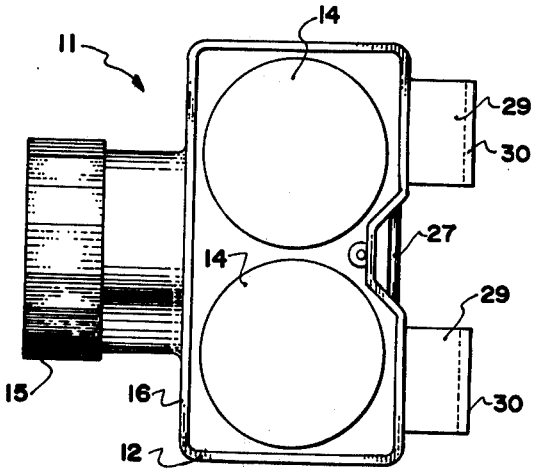
FIG. 3 is a top view of the lamp assembly of FIG. 2 with the lid removed to show the interior thereof.

In this embodiment, the invention comprises a battery case 12 with a hinged lid 13 so that access can be had to the interior of the battery case for replacement of conventional battery cells illustrated by reference character 14 in FIG. 3.

Figure 4:
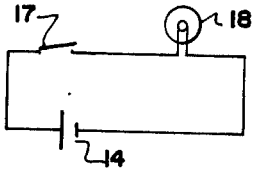
FIG. 4 is a schematic diagram of the circuit in which a partially rotatable lens assembly acts as a switch for the lamp.

A lens assembly 15 is secured to the front panel 16 of the battery case and preferably is partially rotatable to act as a switch 17 (see FIG. 4) to open and close the circuit between the lamp 18 and the battery 14.

Means are provided to detachably secure the assembly to the front of the helmet 10 and take the form of a pair of plates 19 secured by means of screws or rivets 20 to the front of the helmet in spaced apart relationship. Open sided vertically situated jaws 21 are formed on the inner sides of the plates 19 and substantially cylindrical rod portions 22 are formed on each side of the battery case 12 adjacent the rear side thereof. These rods are adapted to slide vertically within the jaws 21 so that the assembly may be engaged and disengaged from the helmet readily and easily as clearly shown.

Figure 2:
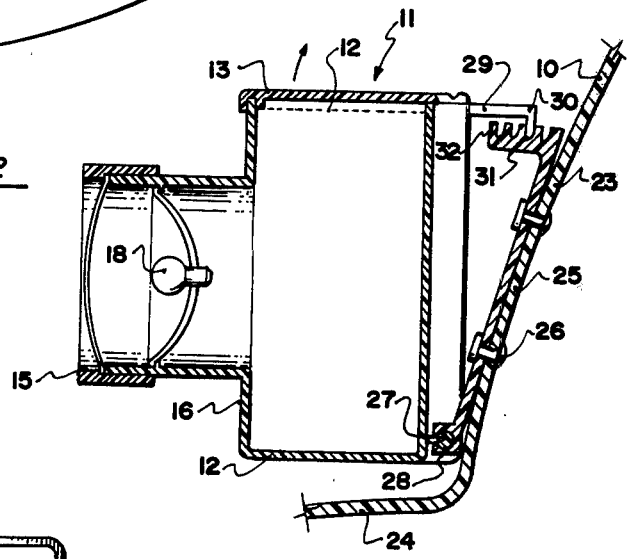
FIG. 2 is a fragmentary cross sectional view of the front part of the helmet showing the preferred embodiment secured thereto, said peferred embodiment also being partially sectioned to show the interior thereof.

Preferred embodiment is shown in FIGS. 2 and 3 and once again is secured to the front portion 23 of the helmet just above the front peak portion 24.

It also includes the battery case 12 with the hinged lid 13 so that access may be obtained to the battery cells 14 within. A lens and lamp assembly 15 is secured to the front panel 16 in a manner similar to that hereinbefore described and switch 17 may also be incorporated to operatively connect and disconnect the lamp 18 from the battery cells 14.

In this embodiment, a pair of members 25 are secured to the front 23 of the helmet in spaced apart relationship by means of rivets 26 or any other suitable means. A horizontal rod 27 is provided spanning the rear lower side of the battery case and this rod snap engages within jaws 28 formed on the lower ends of each of the members 25 thus mounting the lamp assembly 11 to the helmet for fore and aft pivotal movement around the axis of the horizontal rod 27.

Means are provided at the upper end of members 25 to detachably hold the lamp assembly in the desired position relative to the front of the helmet and in this embodiment, a pair of resilient legs 29 extend rearwardly from the battery case adjacent the upper rear side thereof, each leg having a down-turned clip portion 30 formed thereon. These portions are preferably made from synthetic plastic, but of course metal clips can be used if desired.

Tooth members or portions 31 extend forwardly from the upper end of each of the members 25 with the individual teeth 32 extending upwardly therefrom and the claw or clip 30 of the legs snap engages between these teeth as the lamp assembly is moved forwardly or rearwardly, pivoting around the axis of the transverse rod 27 thus making an easily adjusted and easily detached assembly for a safety hat or the like.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A lamp assembly for the front of a protective hat such as a helmet hard-hat and the like, comprising in combination a battery case for detachably receiving dry batteries and a lens assembly secured to said battery case and being operatively connected to the batteries within the battery case, and means to detachably secure said assembly to the front of the associated protective hat, said means to detachably secure said assembly to the front of the associated protective hat including means to adjust, within limits, the angle of the lamp assembly in a fore and aft position relative to said protective hat, said means to adjust the angle of the lamp assembly including a longitudinal pivot attachment of the lower side of said battery case to said protective hat, at least one resilient leg extending rearwardly of said battery case adjacent the upper side thereof and means on said front of said protective hat selectively engageable by the distal end of said leg to detachably hold said lamp assembly in the desired angle relative to said protective hat.

2. The assembly according to claim 1 in which said means to detachably secure said assembly includes a pair of spaced apart supports secured to said protective hat, substantially vertical jaws formed on the inner sides of said supports and substantially vertical jaw engaging portions on each side of said battery case slidably engaging said jaws.

3. The assembly according to claim 1 which includes a pair of legs extending rearwardly of said battery case, one adjacent each end side thereof, a clip extending from the distal ends of each of said legs and a multi-tooth member extending forwardly from the front of said protective hat, said clips engaging between the teeth of said multi-tooth member.

4. The assembly according to claim 1 in which said horizontal attachment includes a substantially horizontal rod secured to said battery case adjacent the lower rear side thereof, a pair of resilient jaws secured to and extending from the front of said protective hat, said rod snap engaging said jaws.

5. The assembly according to claim 2 which includes a pair of legs extending rearwardly of said battery case, one adjacent each end side thereof, a clip extending from the distal ends of each of said legs and a multi-tooth member extending forwardly from the front of said protective hat, said clips engaging between the teeth of said multi-tooth member.

6. The assembly according to claim 2 in which said horizontal attachment includes a substantially horizontal rod secured to said battery case adjacent the lower rear side thereof, a pair of resilient jaws secured to and extending from the front of said protective hat, said rod snap engaging said jaws.

7. The assembly according to claim 4 in which said horizontal attachment includes a substantially horizontal rod secured to said battery case adjacent the lower rear side thereof, a pair of resilient jaws secured to and extending from the front of said protective hat, said rod snap engaging said jaws.

8. The assembly according to claim 5 in which said jaws are formed on the lower ends of said multi-tooth member.

* * * * *